US009664072B2

(12) United States Patent
Evans

(10) Patent No.: US 9,664,072 B2
(45) Date of Patent: May 30, 2017

(54) SWITCHABLE HYDRAULIC LASH ADJUSTER WITH EXTERNAL SPRING AND SOLID STOP

(71) Applicant: Schaeffler Technologies GmbH & Co. KG, Herzogenaurach (DE)

(72) Inventor: Matthew Evans, Warren, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 224 days.

(21) Appl. No.: 14/494,666

(22) Filed: Sep. 24, 2014

(65) Prior Publication Data

US 2015/0083063 A1 Mar. 26, 2015

Related U.S. Application Data

(60) Provisional application No. 61/882,168, filed on Sep. 25, 2013.

(51) Int. Cl.

| | |
|---|---|
| ***F01L 1/34*** | (2006.01) |
| ***F01L 1/24*** | (2006.01) |
| ***F01L 13/00*** | (2006.01) |

(52) U.S. Cl.

CPC ..... *F01L 1/2405* (2013.01); *F01L 13/0005* (2013.01); *F01L 2101/00* (2013.01); *F01L 2103/00* (2013.01)

(58) Field of Classification Search

CPC . F01L 3/10; F01L 2003/11; F01L 2001/2433; F01L 1/2416; F01L 1/24; F01L 1/2405; F01L 2001/467; F01L 1/20; F01L 2001/2438; F01L 2001/2444; F01L 1/146; F01L 1/181; F01L 1/185; F01L 13/0005; F01L 13/04; F01L 13/06; F01L 13/0031; F01L 2101/00; F01L 2103/00; F01L 2105/00; F02D 13/04

USPC ..... 123/90.15, 90.16, 90.52

See application file for complete search history.

(56) References Cited

U.S. PATENT DOCUMENTS

| | | | | |
|---|---|---|---|---|
| 3,875,910 A * | 4/1975 | Zink | F01L 1/2405 | 123/90.46 |
| 4,615,307 A * | 10/1986 | Kodama | F01L 1/2405 | 123/198 F |
| 6,418,894 B1 * | 7/2002 | Haas | F01L 1/24 | 123/198 F |

(Continued)

FOREIGN PATENT DOCUMENTS

| | | | |
|---|---|---|---|
| DE | 10122373 A1 * | 11/2002 | F01L 1/2405 |

*Primary Examiner* — Mark A Laurenzi
*Assistant Examiner* — Kelsey Stanek
(74) *Attorney, Agent, or Firm* — Volpe and Koenig, P.C.

(57) ABSTRACT

A valve train of an internal combustion engine with a switchable hydraulic lash adjuster (SHLA) is provided, including a cylinder head having a boss, with an opening defined in the boss. The SHLA is located in the opening, and the SHLA includes: an outer housing having an inner bore, an inner housing movably located in the inner bore of the outer housing, and including a spring retainer at an outer end thereof, and a plunger assembly with a hydraulic lash adjuster mechanism movably located in a bore of the inner housing. A lost motion spring is located between the spring retainer and a spring seat located around the boss. This arrangement reduces the overall packaging length of the SHLA in that only a fraction of the lost motion spring's installed height has an influence on the overall length of the SHLA.

19 Claims, 2 Drawing Sheets

(56) References Cited

U.S. PATENT DOCUMENTS

| | | | | |
|---|---|---|---|---|
| 8,215,276 | B2 | 7/2012 | Hendriksma | |
| 2003/0111034 | A1* | 6/2003 | Seitz | F01L 1/2405<br>123/90.48 |
| 2009/0126673 | A1* | 5/2009 | Cullen | F01L 1/462<br>123/193.5 |
| 2010/0186691 | A1* | 7/2010 | Werler | F01L 1/2405<br>123/90.12 |
| 2012/0186546 | A1* | 7/2012 | Cecur | F01L 1/146<br>123/90.15 |

* cited by examiner

SWITCHABLE HYDRAULIC LASH ADJUSTER WITH EXTERNAL SPRING AND SOLID STOP

INCORPORATION BY REFERENCE

The following documents are incorporated herein by reference as if fully set forth: U.S. Provisional Patent Application No. 61/882,168, filed Sep. 25, 2013.

FIELD OF INVENTION

The present invention relates to hydraulic lash adjusters (HLAs) used for supporting roller finger followers in overhead-camshaft valve-trains in internal combustion engines. More particularly, it relates to switchable HLAs having one or more locking pins for selectively engaging and disengaging activation of valves in valve-trains.

BACKGROUND

In automotive applications, there is a push for energy efficiency. Efficiencies can be gained for example, by selectively deactivating cylinders in a multiple-cylinder internal combustion engine under certain engine load conditions by deactivation of one or more of the engine valves.

For an overhead-cam engine, one known approach is to provide switchable hydraulic lash adjusters that deactivate the roller finger followers (RFFs) by changing the motion of engine cams into a lost motion that is absorbed by the lash adjuster itself instead of transferring the lift motion to the associated valves. Such lash adjusters are known in the art as switchable hydraulic lash adjusters (SHLAs).

One prior art SHLA indicated at 8 in FIG. 5 includes a conventional hydraulic lash adjuster disposed in a plunger assembly having a domed head for engaging the RFF. The plunger assembly itself is slidably disposed in an inner housing containing the locking pins, which in turn is slidably disposed in an outer housing that is located in a corresponding opening in a cylinder head. The inner housing may be selectively latched and unlatched hydro-mechanically to the outer housing by the selective application of force by a spring and pressurized engine oil on the locking pins.

During engine operation in the valve deactivation mode, the locking pins are withdrawn from locking features (typically an annular groove) in the outer housing, and the inner housing is then reciprocally driven in oscillation by the socket end of the RFF which pivots on its opposite pad end on the valve stem where the valve spring acts with sufficient force so that the valve remains immobile as the cam lobe acts on the RFF. The inner housing is returned during half the lost motion reciprocal cycle by lost motion spring(s) disposed between the inner housing and the outer housing.

In this known prior art SHLA, the required lost motion spring packaging space is significantly larger than that of a non-switching HLA and so the packaging length in an engine is necessarily longer than desired. Given the space requirements, this option is often not even considered for implementation in new higher efficiency engines.

Another arrangement is disclosed in U.S. Pat. No. 8,215,276 which reduces the packaging length of the SHLA by utilizing oil pressure alone or in combination with a shorter spring located in the outer housing that presses against the bottom of the inner housing. However, this arrangement still suffers from shortcomings due to the need for a further pressurized hydraulic oil supply gallery in the engine head.

It would be desirable to provide an improved SHLA which requires less packaging length than is currently available.

SUMMARY

Briefly stated, a valve train of an internal combustion engine with a switchable hydraulic lash adjuster is provided, comprising a cylinder head having a boss, with an opening defined in the boss. The SHLA is located in the opening, and the SHLA comprises: an outer housing having an inner bore, an inner housing movably located in the inner bore of the outer housing, and including a spring retainer at an outer end thereof, and a plunger assembly with a hydraulic lash adjuster mechanism movably located in a bore of the inner housing. A lost motion spring is located between the spring retainer and a spring seat located around the boss. This arrangement reduces the overall packaging length of the SHLA in comparison with the prior known designs in that only a fraction of the lost motion spring's installed height has an influence on the overall length of the SHLA. This allows use of the SHLA according to the invention in various additional applications where SHLA's were not considered due to the packaging length requirement.

An SHLA of this type is also provided that is adapted for use in a valve train of an internal combustion engine.

In another aspect of the invention, an internal stop is provided between the inner and outer housing. Preferably a stop surface on a bottom of the inner housing is adapted to contact a bottom surface of the outer housing as a hard stop before lost motion spring reaches a blocked height. Advantageously, this avoids repeated occurrences of compressing the lost motion spring to its blocked height which increases metal fatigue and reduces spring life.

Preferably, the SHLA includes locking pins located in the inner housing that are movable via hydraulic oil pressure from an engaged position, in which the ends of the locking pins engage corresponding seats in the outer housing, to a disengaged position in which the locking pins are pressed into the inner housing allowing the inner housing to move up and down in the outer housing against the force of the lost motion spring in order to deactivate a valve associated with the SHLA.

Preferably, the outer housing is retained in the boss via a locking ring. This is preferably installed via corresponding grooves located on an inner surface of the opening in the boss and the outer surface of the outer housing, with the locking ring engaging in the grooves.

Preferably, an upper stop ring is engaged in a groove in the inner bore of the outer housing and retains the inner housing in the outer housing, allowing the SHLA to be provided as a preassembled unit.

The SHLA according to the invention is preferably used in connection with roller finger followers that engage a support head of the plunger assembly at a first end, and engage a valve stem at a second end. In order to provide clearance for the roller finger follower, the spring retainer can have a reduced profile by tapering the lost motion spring such that it has a smaller diameter in the area of the spring retainer. Alternatively, the spring retainer can include a clearance notch for the roller finger follower since a full 360° support of the spring is not required.

Given the advantages of the SHLA according to the invention, this provides additional opportunities for internal combustion engines to incorporate valve trains with deactivatable valves allowing the engines to run with some cylinders deactivated under certain operating conditioned in order to achieve increased efficiency.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
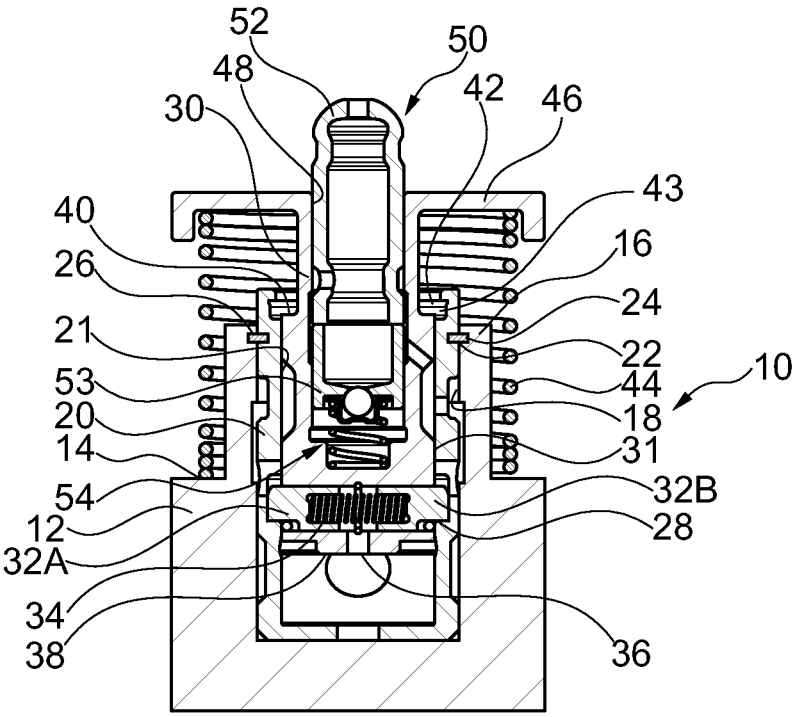
FIG. 1 is a cross-sectional view of a first preferred embodiment of a SHLA according to the present invention.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a cylinder or plunger. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
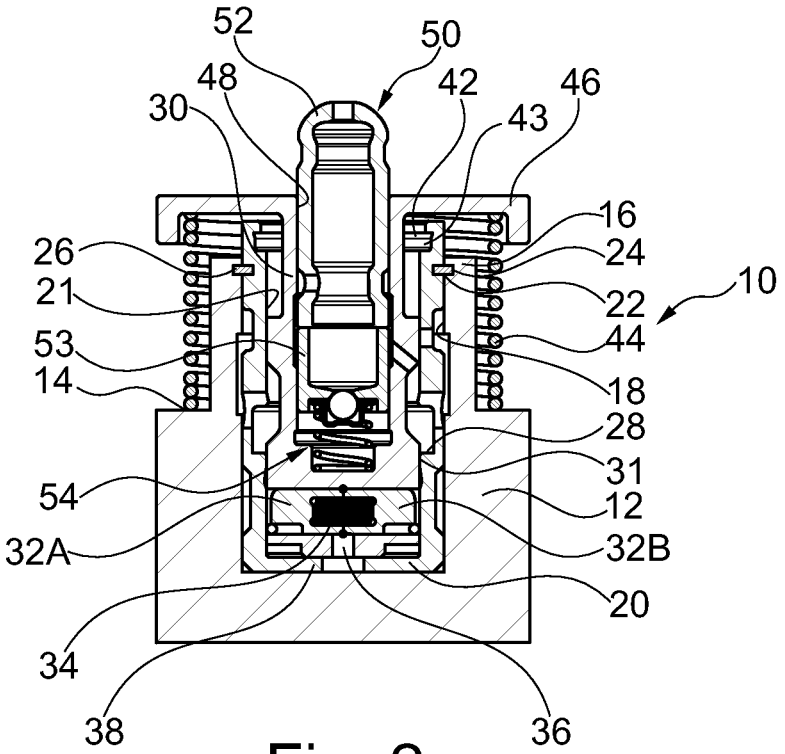
FIG. 2 is a cross-sectional view of the SHLA of FIG. 1 with the locking pins in a disengaged position in order to deactivate an associated valve of an internal combustion engine.
Figure 4:
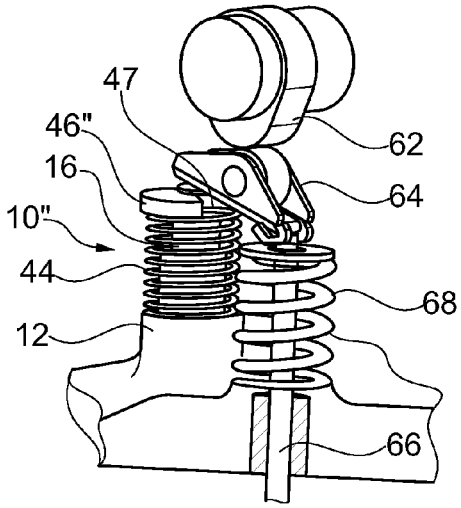
FIG. 4 is a perspective view showing a third embodiment of an SHLA according to the invention installed in a cylinder head.
Figure 5:
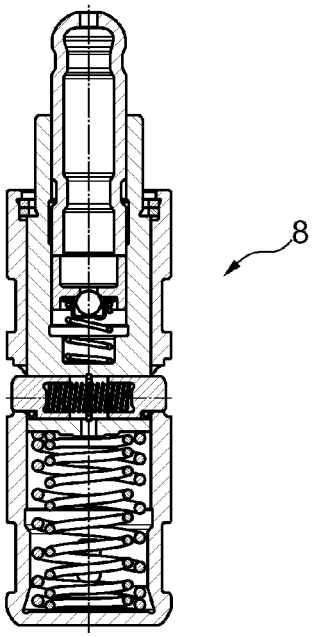
Fig. 5 Prior Art
FIG. 5 is a cross-sectional view of an SHLA according to the prior art.

Referring to FIGS. 1 and 2, a first preferred embodiment of a switchable hydraulic lash adjuster 10 for use in a valve train of an internal combustion engine is shown. The SHLA 10 is received in the opening 18 defined in a boss 16 on a cylinder head 12. The cylinder head 12 also includes a spring seat 14 defined around the boss 16. The SHLA 10 is preferably used in connection with a roller finger follower, such as RFF 64 shown in FIG. 4 which is located between a cam 62 and a valve stem 66 of an intake or exhaust valve used in the valve train of an internal combustion engine. FIG. 4 also illustrates the valve spring 68 which biases the valve to a closed position.

Still with reference to FIGS. 1 and 2, the SHLA 10 includes an outer housing 20 having an inner bore 21. A groove 22 is located near an upper end of the inner bore 21. An inner housing 30 is movably located in the inner bore 21 of the outer housing 20, and includes a spring retainer 46 located at an outer end thereof.

The outer housing 20 is preferably retained in the boss 16 via a locking ring 24 which engages in a groove 22 located in an outer surface of the outer housing 20 and a groove 26 located in the inner surface of the opening 18 in the boss 16. Other retaining arrangements could be provided, if desired.

The outer housing 20 and the inner housing 30 are preferably both cold formed and machined steel parts. However, they can just be machined from round steel stock.

Locking pins 32A, 32B are located in the inner housing 30 and are movable via hydraulic oil pressure from an engaged position, in which outer ends of the locking pins 32A, 32B engage corresponding seats 28 in the outer housing 20, to a disengaged position, in which the locking pins 32A, 32B are pressed into the inner housing 30 allowing the inner housing 30 to move up and down in the outer housing 20 against the force of a lost motion spring 44 located between the spring retainer 46 and the spring seat 14 on the cylinder head 12 located around the boss 16. The locking pins 32A, 32B are of the known type used in the prior art SHLA's and preferably include a spring 34 located between the locking pins 32A, 32B which biases the locking pins 32A, 32B to the engaged position. An opening 36 is provided in the inner housing 30 to allow oil to pass through the base of the inner housing 30.

Still with reference to FIGS. 1 and 2, preferably a stop surface 38 is located on a bottom of the inner housing 30 that is adapted to contact an inside bottom surface of the outer housing 20 as a hard stop before the lost motion spring 44 reaches a blocked height. This provides for increased spring life due to reduced fatigue in comparison to the known prior art SHLAs where a blocked height of the lost motion spring is used as the stop.

Preferably, an upper stop ring 42 is engaged in an upper groove 43 in the inner surface of the outer housing 20 in order to retain the inner housing 30 within the outer housing 20 via contact with a shoulder 40 on the inner housing 30.

A plunger assembly 50 is preferably located in a bore 48 of the inner housing 30. A hydraulic lash adjuster mechanism 54 is located in the plunger assembly 50. The plunger 50 is movable in the bore 48 of the inner housing 30 in order to compensate valve lash. In the preferred embodiment, the plunger assembly 50 includes the support head 52 as well as the base part 53 in which the lash adjuster mechanism 54 is located.

By using the SHLA 10 according to this arrangement, it will be appreciated by those skilled in the art based on the present disclosure that the packaging length of the SHLA 10 is reduced in comparison to the prior art due to the fact that only a fraction of the installed height of the lost motion spring 44 has an influence of the overall length of the SHLA 10. Additionally, the SHLA 10 provides increased reliability and service life due to the use of the hard stop between the inner housing 30 and the outer housing 20.

Figure 3:
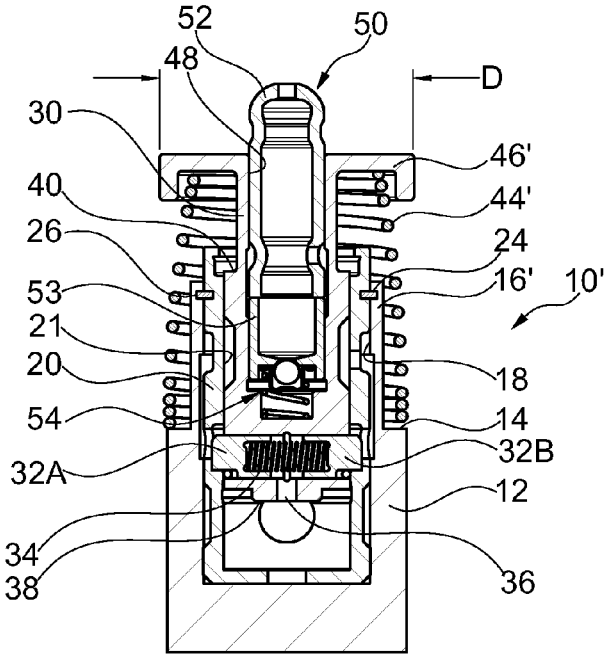
FIG. 3 is a cross-sectional view of a second embodiment of a SHLA according to the invention.

Referring now to FIG. 3, a second embodiment of the SHLA 10' is shown. The SHLA 10' of FIG. 3 is similar to the SHLA 10 shown in FIGS. 1 and 2 except that here, the spring 44' is tapered so that the spring retainer 46' can have a reduced diameter D in comparison to the first embodiment of the SHLA 10 shown in FIGS. 1 and 2. The reduced diameter of the spring retainer 46' allows an arrangement with a smaller radial profile to be used which allows closer spacing and avoids potential interference with the roller finger follower 64 (shown only in FIG. 4). The spring diameter is also shown reduced at the bottom end in comparison to the SHLA 10, via a reduction in the outside diameter of the boss 16' on the cylinder head 12. However, the function of the SHLA 10' remains the same as that of the SHLA 10 described above in connection with the first embodiment, and similar features are identified with the same reference numbers.

Referring to FIG. 4, a third embodiment of the SHLA 10" in accordance with the present invention is shown. The SHLA 10" is the same as the SHLA 10 shown in FIGS. 1 and 2 except that the spring retainer 46' includes a notch 47 in an area of the roller finger follower 64 in order to provide additional clearance for the roller finger follower 64. FIG. 4 also illustrates how the boss 16 can be formed on a cylinder head 12 and also shows the arrangement of a valve with the valve stem 66 extending through a valve guide bushing, with the end of the valve stem 66 being acted upon by the pad end of the roller finger follower 64.

The SHLAs 10, 10', 10" according to the invention all provide for reduced packaging length over the known prior art SHLAs to allow for incorporation of SHLAs into additional engine designs where space is at a premium. Further, the hard stop between the stop surface 38 of the inner 30 housing against the inside bottom of the outer housing increases the life of the loss motion spring 44, 44' allowing for a longer operating life.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A valve train of an internal combustion engine with a switchable hydraulic lash adjuster, comprising:

a cylinder head having a boss, with an opening defined in the boss;

a switchable hydraulic lash adjuster located in the opening, the switchable hydraulic lash adjuster comprising:

an outer housing having an inner bore;

an inner housing movably located in the inner bore of the outer housing and including a spring retainer at an outer end; and a plunger assembly with a hydraulic lash adjuster mechanism movably located in a bore of the inner housing; and a single lost motion spring located between the spring retainer and a spring seat on the head located around the boss, and the single lost motion spring is at least partially located concentrically around the boss of the cylinder head.

2. The valve train of claim 1, further comprising locking pins located in the inner housing that are movable via hydraulic oil pressure from an engaged position, in which ends of the locking pins engage corresponding seats in the outer housing, to a disengaged position, in which the locking pins are pressed into the inner housing allowing the inner housing to move up and down in the outer housing against a force of the single lost motion spring.

3. The valve train of claim 1, wherein the outer housing is retained in the boss via a locking ring.

4. The valve train of claim 3, wherein corresponding grooves are located on an inner surface of opening in the boss and an outer surface of the outer housing, and the locking ring engages the grooves.

5. The valve train of claim 1, further comprising a stop surface on a bottom of inner housing that is adapted to contact a bottom surface of the outer housing as a hard stop before the single lost motion spring reaches a blocked height.

6. The valve train of claim 1, further comprising an upper stop ring engaged in a groove in the inner bore of the outer housing that retains the inner housing in the outer housing.

7. The valve train of claim 1, wherein the single lost motion spring is tapered, and has a smaller diameter in an area of the spring retainer.

8. The valve train of claim 1, further comprising a roller finger follower that engages a support head of the plunger assembly at a first end and engages a valve stem at a second end.

9. The valve train of claim 1, wherein the spring retainer includes a clearance notch for the roller finger follower.

10. The valve train of claim 1, wherein the spring retainer is integrally formed with the inner housing at the outer end.

11. The valve train of claim 1, wherein the spring retainer comprises a flange integrally formed at the outer end of the inner housing.

12. A switchable hydraulic lash adjuster adapted for use in a valve train of an internal combustion engine which includes a cylinder head with a boss and an opening defined in the boss in which the switchable hydraulic lash adjuster is adapted to be located, the switchable hydraulic lash adjuster comprising:

an outer housing having an inner bore;

an inner housing movably located in the inner bore of the outer housing and including a spring retainer at an outer end;

a plunger assembly with a hydraulic lash adjuster mechanism movably located in a bore of the inner housing; and a single lost motion spring adapted to be located between the spring retainer and a spring seat on the head located around the boss, and the single lost motion spring is adapted to be at least partially located concentrically around the boss of the cylinder head.

13. The switchable hydraulic lash adjuster of claim 12, further comprising locking pins located in the inner housing that are movable via hydraulic oil pressure from an engaged position, in which ends of the locking pins engage corresponding seats in the outer housing, to a disengaged position, in which the locking pins are pressed into the inner housing allowing the inner housing to move up and down in the outer housing against a force of the single lost motion spring.

14. The switchable hydraulic lash adjuster of claim 12, wherein the outer housing is adapted to be retained in the boss via a locking ring.

15. The switchable hydraulic lash adjuster of claim 14, wherein a groove is located on an outer surface of the outer housing, and the locking ring engages the groove.

16. The switchable hydraulic lash adjuster of claim 12, further comprising a stop surface on a bottom of inner housing that is adapted to contact a bottom surface of the outer housing as a hard stop before the single lost motion spring reaches a blocked height.

17. The switchable hydraulic lash adjuster of claim 12, further comprising an upper stop ring engaged in a groove in the inner bore of the outer housing that retains the inner housing in the outer housing.

18. The switchable hydraulic lash adjuster of claim 12, wherein the single lost motion spring is tapered, and has a smaller diameter in an area of the spring retainer.

19. The switchable hydraulic lash adjuster of claim 12, wherein the spring retainer includes a clearance notch for the roller finger follower.

* * * * *